United States Patent [19]

Miller

[11] 4,355,987

[45] Oct. 26, 1982

[54] LIFE RAFT INFLATION SYSTEM

[75] Inventor: David D. Miller, Bricktown, N.J.

[73] Assignee: The Garrett Corporation, Los Angeles, Calif.

[21] Appl. No.: 196,730

[22] Filed: Oct. 15, 1980

[51] Int. Cl.[3] ..... B63C 9/24

[52] U.S. Cl. ..... 441/41; 441/42

[58] Field of Search ..... 244/149; 441/40–42, 441/90, 91, 93, 94, 99, 101

[56] References Cited

U.S. PATENT DOCUMENTS

| | | | |
|---|---|---|---|
| 1,988,872 | 1/1935 | Knight | 244/149 |
| 2,128,423 | 8/1938 | Manson | 8/18 |
| 2,384,651 | 9/1945 | Smith | 244/149 |
| 2,444,859 | 7/1948 | Sturtevant | 9/2 A |
| 2,481,116 | 9/1949 | Horning | 244/151 |
| 2,510,843 | 6/1950 | Townshend | 9/11 A |
| 2,774,979 | 12/1956 | Moran | 9/19 |
| 2,826,337 | 3/1958 | Ford et al. | 222/3 |
| 3,023,932 | 3/1962 | Hennis | 222/5 |
| 3,212,112 | 10/1965 | Reffell | 9/11 A |
| 3,321,785 | 5/1967 | Soubiran | 9/316 |
| 3,448,471 | 6/1969 | Oldham | 9/11 A |
| 3,563,036 | 2/1971 | Smith et al. | 244/149 |
| 3,685,066 | 8/1972 | Edwards | 9/11 A |
| 3,828,381 | 8/1974 | Prager | 9/316 |

FOREIGN PATENT DOCUMENTS

| | | | |
|---|---|---|---|
| 2105551 | 4/1972 | France | 9/11 A |
| 111161 | 7/1967 | Norway | 9/11 A |
| 903876 | 8/1962 | United Kingdom . | |

*Primary Examiner*—Sherman D. Basinger
*Assistant Examiner*—Stephen P. Avila
*Attorney, Agent, or Firm*—J. Richard Konneker; Albert J. Miller

[57] ABSTRACT

An actuating system for inflating a dual compartment life raft includes a spaced pair of inflation tanks, each mounted on a different one of the two compartments for relative movement when inflation of the raft is initiated. One end of each of a pair of pullout cables is operatively connected to a different one of the tank valves, with the free end of each cable being anchored to the other tank valve. A pull lanyard is secured to the cables for movement along their lengths. A short pull stroke on the lanyard in any direction opens both tank valves. In the event that only one tank valve is manually opened in this manner, the resulting partial inflation of the raft moves the tanks further apart, pulling the still connected cable from its valve and automatically completing the inflation process.

29 Claims, 5 Drawing Figures

LIFE RAFT INFLATION SYSTEM

BACKGROUND OF THE INVENTION

1. Field of the Invention

The present invention relates generally to inflatable life rafts, and more particularly to a novel lanyard and cable inflation actuation system therefor.

2. Description of Prior Art

It is a common safety requirement for aircraft having regularly scheduled flights over large bodies of water to be provided with emergency inflatable life rafts for use by the passengers and crew in the event of a forced water landing. Such life rafts, especially in the larger sizes, typically have two separately inflatable chambers or sections. Upon each of the sections is mounted a cylindrical inflation tank having an outlet valve communicating with the interior of the section. In order for the raft to safely carry its rated number of people, it is necessary that both sections be inflated.

To open the valves and inflate the two raft sections, each of the outlet valves is provided with a pullout-type valve release cable. The outer ends of the cables are fixedly secured to an activating lanyard. The raft is inflated by pulling the lanyard to an extent necessary to pull both the cables out of their valves.

Despite the simplicity and rather straightforward design of this inflation system, it carries with it the very real potential for under inflating the raft in an emergency situation—particularly when an inexperienced person attempts to actuate the inflation system. Because the two inflation tanks are normally mounted in a spaced side-by-side parallel relationship, and the release cables are of substantially equal lengths, the length of lanyard "pull" necessary to open both valves varies with the direction of such pull. Specifically, when the lanyard is pulled directly away from the tanks (i.e., in a "proper" direction parallel to the longitudinal axes of the tanks), the pull stroke is at its shortest length and opens both valves substantially simultaneously, fully inflating the raft.

However, if the lanyard is pulled at an angle relative to the tank axes, two things happen. First, one of the valves is opened before the other. Secondly, the total length of the necessary lanyard pull stroke is increased in proportion to the magnitude of such pull angle.

The danger that this "directional" lanyard pull characteristic presents is that if the pull angle is sufficiently large, a concomitantly large delay between the opening of the first and second valve occurs during pulling of the lanyard through its unavoidably increased stroke. Thus, an inexperienced passenger in a panic situation could easily improperly pull the lanyard to one side through a relatively short stroke and, hearing the gas escaping from the first tank, immediately release the lanyard and assume that the inflation process is then correctly initiated. The result is an abnormal inflation of the raft and potential reduction in functional service thereof.

Each of the release cables in the above-described conventional actuation assembly is connected to a cam mechanism within one of the tank valves, and rotates the cam to open the valve when the cable is pulled therefrom. To diminish the potential for inadvertent deployment of the raft, the force required to pull a cable out of its valve is made fairly large. When the lanyard is pulled in the proper, generally "straight-out" direction, so that the two tank valves are opened simultaneously, the required lanyard pull force is maximized and is equal to the sum of the individual cable pull forces. The undesirable situation thus exists that when the lanyard is pulled in the designed-for direction, its operation is the most difficult.

It can be seen that a need exists for improvements in conventional lanyard and cable inflation actuation systems to upgrade both their reliability and ease of operation and to assure full inflation of the life raft. Accordingly, it is an object of the present invention to provide an improved inflation actuation system which eliminates or minimizes above-mentioned and other problems.

SUMMARY OF THE INVENTION

In carrying out principles of the present invention, a lanyard and cable inflation actuation system for the dual tank and valve assemblies of an inflatable life raft pack or the like is provided which opens both valves in response to a short pull stroke of the lanyard in any direction. Unlike conventional lanyard and cable actuation systems, neither the length nor the force required to accomplish such pull stroke varies significantly with its direction. Thus, the reliability and operation of the raft's inflation system are substantially improved.

In a preferred embodiment of the present invention, these desirable operational improvements are accomplished by providing a pair of valve release cables, operatively connecting one of the cables to one of the tank valves and the other cable to the other tank valve, providing a cable linking member having an opening extending therethrough, passing each of the cables through the opening, securing the outer end of the valve cable of each valve to the other valve, providing an actuating lanyard, and securing the lanyard to the cable linking member.

DETAILED DESCRIPTION

Figure 1:
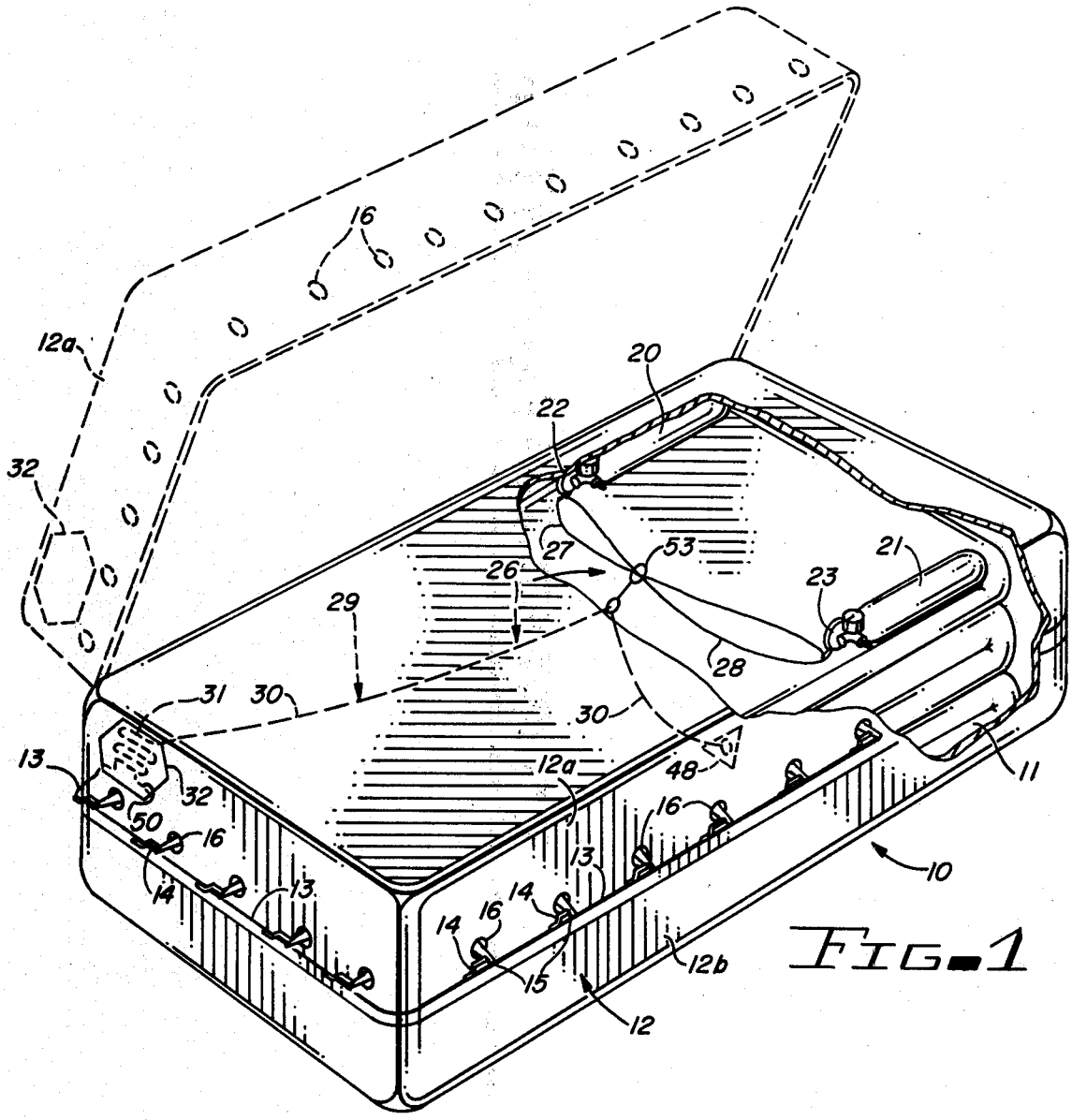
FIG. 1 is a partially cutaway perspective view of a representative inflatable life raft pack to which is attached a lanyard and valve release cable actuating assembly embodying principles of the present invention.

Illustrated in FIG. 1 is a representative self-inflatable life raft pack 10 of the type routinely stowed on aircraft having scheduled flights over large bodies of water. The raft pack 10 includes an inflatable raft body 11 stored, in a deflated and folded condition, within an elongated fabric container 12 having a generally rectangular cross-section. The container 12 is vertical divided, along its end walls and one of its side walls, into upper and lower sections 12*a*, 12*b*. This permits the two sections to be pivoted away from each other along the length of the container (as indicated in phantom in FIG. 1) to facilitate packing of the raft body and, upon activation of its inflation system, to prevent the container from obstructing the raft's expansion.

Figure 3:
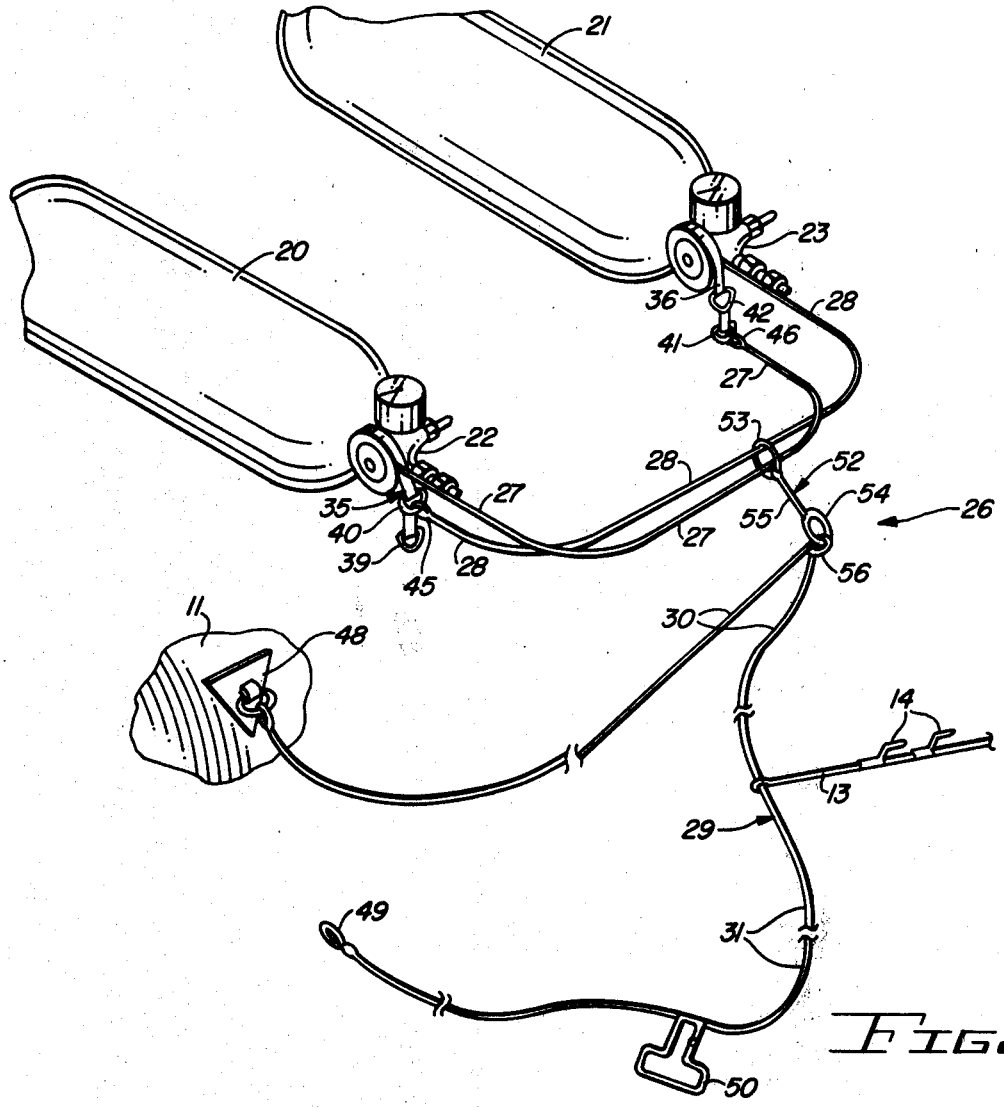

Upper and lower container sections 12*a*, 12*b* are releasably retained in their closed configuration by means of a conventional container release cable 13 extending along the ends and divided side of the container and having secured thereto a longitudinally spaced series of hook members 14 (see FIG. 3). The outer end of each of the hook members 14 is extended through a transverse opening formed through one of a series of generally cone-shaped fastening members 15 secured to the lower container section 12*b* and extended through one of a series of grommeted openings 16 formed in the upper container section 12*a*.

To inflate the raft body 11, which has two separately inflatable chambers or sections, a pair of cylindrical compressed gas tanks 20, 21 are used, tank 20 being mounted on one of the inflation sections, and tank 21 being mounted on the other section. Tanks 20, 21, respectively, have outlet valves 22, 23, each of which is operatively connected to a jet pump (not shown) in its tank's inflation section.

The raft pack 10 is provided with an actuating lanyard and valve release cable assembly 26 which embodies principles of the present invention and substantially improves the safety and reliability of the raft's inflation system. The assembly 26 includes a pull-out type valve release cable 27 operatively connected to the outlet valve 22, a pull-out type valve release cable 28 operatively connected to the outlet valve 23, and an activating lanyard 29 having an inner end portion 30 linked to the valve release cables 27, 28 in an unique manner described below. An outer end portion 31 of the activating lanyard is faked (i.e., coiled) within a storage pouch or pocket flap 32 on the left end wall (as viewed in FIG. 1) of the container 12. An end of the container release cable 13 is secured to such outer lanyard end portion 31 (FIG. 3).

Generally, when the aircraft is forced to make a water landing, the raft pack 10 is deployed by uncoiling the lanyard outer end portion 31, securing its free end to the aircraft, and then throwing the container 12 into the water. To activate the raft's inflation system, the lanyard 29 is then pulled outwardly from the container. The resulting movement of the lanyard relative to the container operates the container release cable 13 to pull the retaining hooks 14 from the fastenings members 15, thereby permitting substantially unfettered expansion of the raft body 11. At the same time, such lanyard movement operates the valve release cables 27, 28 to open the valves 22, 23 and inflate both raft body sections. Finally, when the passengers have boarded, the lanyard is cut to free the inflated raft from the aircraft.

Figure 2:
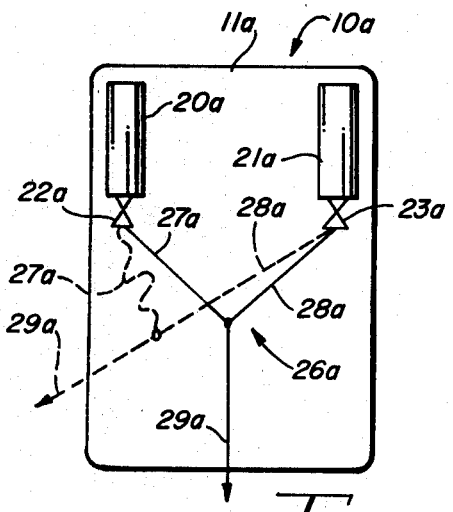
FIG-2 (PRIOR ART)
FIG. 2 is a diagof the actuating assembly of FIG. 1.

Before describing the novel structure and operation of the lanyard and cable assembly, or pull means 26, the construction and operational disadvantages of a conventional lanyard and cable system will be briefly reviewed with reference to FIG. 2 in which components similar to those in FIG. 1 have been given identical reference numerals (with the suffix "a") for ease of comparison.

In the conventional raft pack 10*a* of FIG. 2, the inflation tanks 20*a*, 21*a* (like the tanks 20, 21) are positioned on the raft body 11*a* in a spaced, side-by-side, longitudinally aligned, parallel relationship with the outlet valves 22*a*, 23*a* facing in the same direction. The valve release cables 27*a*, 28*a* are of substantially equal lengths and are fixedly secured at their outer ends to the activating lanyard 29*a*.

As indicated by the solid lines in FIG. 2, when the lanyard 29*a* is initially pulled directly downwardly (i.e., in a "proper" direction parallel to the longitudinal axes of the tanks 20*a*, 21*a* the release cables 27*a*, 28*a* are simultaneously tensioned. A further downward pull of the lanyard simultaneously pulls the valve release cables from their valves, thereby inflating both sections of the raft body 11*a*. It can be seen that the lanyard pull force required to pull each of the valve release cables from its valve is equal to twice the pull force required to remove either of the release cables from its valve. Additionally, the required lanyard pull distance, after the valve release cables are simultaneously tensioned, is at least approximately equal to the pull length required to remove either of the release cables from its valve.

However, when the lanyard 29*a* is initially pulled off to one side (for example, to the left as indicated in phantom in FIG. 2) only one of the cables (28*a*) is initially tensioned, the other release cable being considerably slackened. A further pull to the left detaches the release cable 28*a* from its valve 23*a* and inflates one of the raft's sections. The lanyard 29*a* must then be pulled a substantial additional distance to tension and then detach the release cable 27*a* from its valve 22*a*.

It can be seen that the required total lanyard pull force, the distance which the lanyard must be pulled to open both the valves 22*a*, 23*a*, and the time delay between the opening of one of the valves and the other valve all vary according to the direction in which the lanyard is pulled. This "directional" characteristic of the lanyard 29*a* can, in an emergency situation, pose potentially serious problems—especially when an inexperienced person attempts to activate the raft's inflation system.

For example, when the lanyard is pulled straight out from the valves, a considerable pull force is required to open both valves—i.e., generally twice the individual cable pull force. However, a more serious problem is presented when the cable is pulled at a substantial angle relative to the tank axes. When the first cable is pulled out of its valve, the lanyard goes slack. At the same time, one of the raft sections begins to inflate. The sound of this partial inflation can easily cause an inexperienced operator to assume full raft inflation will result and to thus simply release the lanyard without pulling it through the remainder of its substantially lengthened stroke. The result is under-inflation of the raft.

In contrast, the valves 22, 23 of the raft pack 10 may be substantially simultaneously opened by pulling the lanyard 29 of the actuation assembly 26 through a short pull stroke in any direction. Because of a unique interconnection between the lanyard 29 and the valve release cable 27, 28, the required total length of such pull stroke is substantially constant regardless of its direction. Additionally, as will be seen, the lanyard pull force required to open both valves is also substantially unaffected by the direction of the pull stroke.

Figure 5:
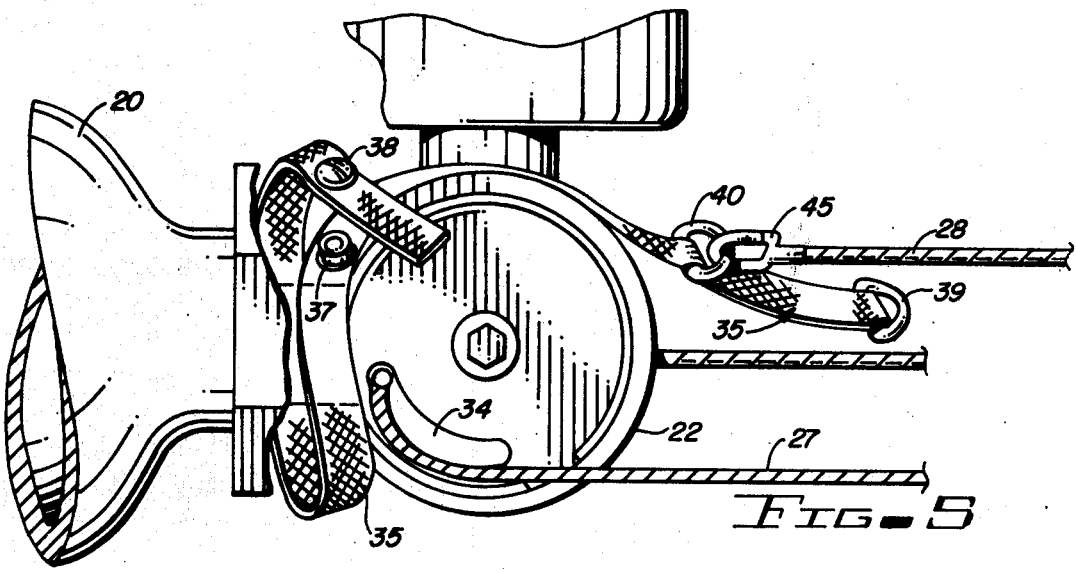
FIG. 5 is a greatly enlarged, fragmentary, and partially cutaway perspective view illustrating the attachment of a cable connecting strap to one of the inflation tank and valve assemblies depicted in FIG. 3.

Referring now to FIGS. 3 and 5, each of the inflation valves 22, 23 of the raft pack 10 has a conventional cam type operating mechanism 34 (FIG. 5) which, when rotated, opens the valve. Inner end portions of the pull-out-type valve release cables 27, 28, respectively, are releasably connected to the cam mechanisms of the valves 22, 23 so that when the cables are pulled from their valves the cam mechanisms are rotated. The cables 27, 28 are of substantially equal lengths and are each longer than the distance between the valves 22, 23.

Unlike the previously described conventional lanyard and cable assembly 26*a*, the free or outer ends of the cables 27, 28 are not fixedly secured to the lanyard 29. Instead, they are respectively anchored to the valves 22, 23 as indicated in FIG. 3. This outer end anchoring, which positions the valve cables so that they extend in generally opposite directions between the outlet valves, is accomplished by means of identical cable attachment straps 35, 36.

As illustrated in FIG. 5, an inner end portion of strap 35 is looped around the neck of valve 22 and is connected thereto by means of stud and receptacle snap fastener portions 37, 38 attached to such inner strap end portions. Secured to the outer end of the strap 35 is an "outer" D-ring 39. An "inner" D-ring 40 is also secured to the outer end portion of strap 35, and is positioned slightly longitudinally inwardly of ring 39. Strap 36 is connected to the valve 23 (FIG. 3) in a similar manner and has an outer D-ring 41, and an inner D-ring 42. A positive attachment hook 45 on the outer end of cable 28 releasably connects it to the inner ring 40 of strap 35, and a positive attachment hook 46 on the outer end of cable 27 releasably connects cable 27 to the outer ring 41 on the strap 36. This connection of the outer cable ends to different strap rings increases the effective length of the cable 27 relative to the cable 38 to thereby provide a slight delay between the opening of the valve 22 and the valve 23 as described below.

As indicated in FIG. 3, the free end of the inner lanyard end portion 30 is connected to a high strength raft tie-off patch 48 secured to the raft body 11. A snap hook 49 is provided on the free end of the outer lanyard end portion 31 for securing the lanyard to the aircraft prior to deploying the raft pack 10. Secured to the outer lanyard end portion 31 between the snap hook 49 and the container release cable 13 in a lanyard pull handle 50.

The inner lanyard end portion 30 is connected to the valve cables 27, 28 for movement along their lengths between the tank and valve assemblies 20, 22 and 21, 23 by means of a linking member 52 comprising a pair of metal rings 53, 54 fixed to opposite ends of a short length of cable 55. Prior to their connection to the cable attachment straps 35, 36, the cables 28, 27 are each extended through the ring 53. The inner lanyard end portion 30 is secured to the other ring 54 by means of a bowline knot 56. By pulling the lanyard handle 50 away from the tanks 20, 21, the container release cable 13 is operated to open the container 12, and the valve cables 27, 28 are pulled from the tank outlet valves to inflate both sections of the raft body 11.

Figure 4:
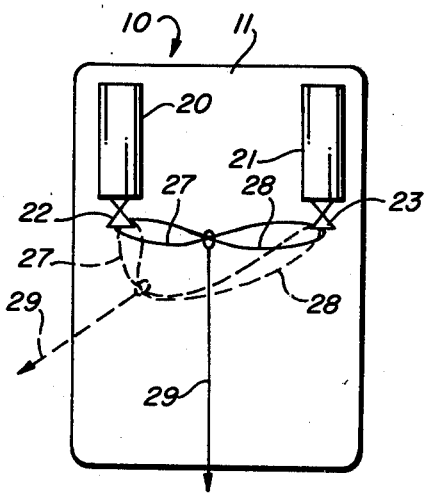
FIG. 4 is a diagrammatic view of a portion of the actuating assembly of FIG. 1.

Because the lanyard 29 is connected to the outer end—restrained valve cables 27, 28 for movement along their lengths, a pull force exerted on the lanyard handle 50 is transferred to such cables, via the linking member ring 53, at adjacent intermediate points along their lengths, regardless of the direction in which the lanyard is pulled. The position of these adjacent points along the cables varies with the lanyard pull angle, the movably connected lanyard being "self-centering" relative to the valve cables. More specifically, when the lanyard 29 is initially pulled to one side (for example, to the left as indicated in phantom in FIG. 4), the cross-connected valve cables are forced into a parallel, similarily angled relationship. A further "angled" pull of the lanyard tensions the cable 28 and begins to open its valve 23. During, or just slightly after, the opening of the valve 23, the cable 27 is tensioned and pulled from its valve 22.

It is important to note that the connection of the equal length valve cables 27, 28, respectively, to the outer and inner strap rings 41, 40 introduces a slight degree of slack in cable 27 relative to cable 28 at the outset of the lanyard pull stroke to thereby provide a predetermined delay, or "staging" between the opening of the outlet valves. However, due to the sliding connection of the lanyard 29 to the valve cables, the amount of this predetermined relative slack remains constant regardless of the direction of the lanyard pull stroke. Stated otherwise, an angled lanyard pull on the initially tensioned valve cable does not variably increase the slack in the other valve cable relative thereto. Thus, in the actuation assembly 26, the operation of the lanyard 29 is rendered nondirectional. Neither the required length or force of the lanyard pull stroke, nor the predetermined staging of the valve openings varies significantly with the direction of such pull stroke.

This nondirectional actuation feature, resulting from the previously described unique association of the lanyard and valve cables, provides for safer, more reliable, and much easier activation of the raft's inflation system. Both raft body inflation sections may now be inflated by pulling the lanyard through a short stroke in any direction.

In the unlikely event that such manual pull stroke releases only one of the valve cables (i.e., cable 28) from its valve, thus inflating only one of the raft body sections, a surprising and unusual safety backup feature of the actuation assembly 26 takes over to automatically inflate the other raft section. This very desirable backup safety feature, absent in conventional inflation actuation systems, arises due to the fact that the cross-connection of the outer valve cable ends to the tank and valve assemblies restrains movement of such outer cable ends relative to the raft body.

As previously described, manual operation of one of the valve cables opens one of the tank valves and begins to inflate its raft body section. In the event only one of the cables is manually pulled from its outlet valve, the resulting inflation of one of the raft body sections begins to move the tanks 20, 21 further apart. Such separation of the tanks pulls the still cross-connected valve cable from the valve to which it is operatively connected. This inflation-responsive operation of the other valve cable thus assures inflation of the other raft body section.

The previously described staging in the opening of the tank outlet valves could also be accomplished by using valve cables of different lengths and simply connecting their outer ends directly to the appropriate tank valve. However, the use of the cable attachment straps, with their longitudinally spaced attachment rings, provides two advantages. First, such attachment method allows standardization in the manufacture of the valve cables—i.e., the cables need only be manufactured in one length for a given raft. Secondly, and more importantly, the use of the straps and their rings, along with the equal length cables, allows for a quick visual inspection of the actuation assembly to assure that it is properly connected to the outlet valves. An assembler or inspector has merely to check to see that one of the cables is connected to an inner strap ring and the other cable is connected to an outer strap ring.

Also, if desired, the equal length valve cables could be connected directly to the appropriate tank valves without using the attachment straps. This would still provide all of the previously described advantages of the actuation system 26 except for the staging of the outlet valves. However, such direct connection of equal length valve cables would increase the required force of the lanyard pull stroke since a lanyard pull in any direction would be simultaneously resisted by each of the valve cam mechanisms. By using the cable attachment straps as previously described, and appropriately spacing their attachment rings, the valve cables may be positioned relative to one another so that the second valve cable is tensioned as, or just slightly after, the first valve cable is pulled from its valve, thereby effectively halving the required lanyard pull force and providing much easier operation of the separate tank and valve inflation systems.

In addition to the above-described benefits and advantages of the lanyard and cable actuation system 26, it is quite inexpensive, is easily and quickly installed, and does not significantly affect either the weight or balance of the raft pack 10.

Moreover, the present invention provides a simple, inexpensive method of quickly retrofitting an existing lanyard and cable system (such as the previously described system 26*a*) to eliminate the objectionable directional characteristics of its pull lanyard. Referring to FIG. 2, the conventional lanyard and cable system 26*a* may be quickly converted to the greatly improved system 26 of FIG. 4 by disconnecting and removing the valve cables 27*a*, 28*a* from the lanyard 29*a*, securing a cable linking member 52 to the lanyard, replacing the removed cables with new cables 27, 28, passing the new cables through the linking member ring 53, and then anchoring them to the valves 22*a*, 23*a* by using the previously described cable attachment straps 35, 36.

The foregoing detailed description is to be clearly understood as given by way of illustration and example only, the spirit and scope of this invention being limited solely by the appended claims.

What is claimed is:

1. An inflatable life raft apparatus comprising:

(a) a raft body having first and second inflatable sections;

(b) first inflation means mounted on said raft body for inflating said first section thereof;

(c) second inflation means mounted on said raft body for inflating said second section thereof, said first and second inflation means each including a tank and valve assembly; and (d) pull means, interconnected between said first and second inflation means, for manually actuating either or both of said first and second inflation means, said pull means including means responsive to inflation of one of said raft body sections for automatically actuating the inflation means of the other section in the event that only the inflation means of said one of said raft body sections is manually actuated by said pull means, said pull means further including:

(1) a pair of valve release cables operatively connected to the valves of said tank and valve assemblies and extending between said tank and valve assemblies, said inflation responsive means including one of said cables, (2) means restraining movement of outer end portions of said cables relative to said raft body, (3) an activating lanyard, and (4) means connecting a portion of said lanyard to said cables for movement along their lengths, whereby the valves of said tank and valve assemblies may be opened in response to a pull stroke of said lanyard through a predetermined distance which is substantially independent of the direction of said pull stroke.

2. The raft apparatus of claim 1 wherein said cables are of substantially equal lengths.

3. The raft apparatus of claim 2 wherein the length of each cable is longer than the distance between said valves.

4. An inflatable life raft apparatus comprising:

(a) inflatable raft means including:

(1) an inflatable raft body, (2) first inflation means mounted on said raft body, and (3) second inflation means mounted on said raft body, said first and second inflation means each being operable to inflate a portion of said raft body; and (b) an inflation actuation assembly including:

(1) first elongated flexible means releasably connected at an inner end portion to said first inflation means for operating the same in response to being pulled therefrom, (2) second elongated flexible means releasably connected at an inner end portion to said second inflation means for operating the same in response to being pulled therefrom, (3) means anchoring an outer end portion of said first flexible means to said raft means adjacent said second inflation means, (4) means anchoring an outer end portion of said second flexible means to said raft means adjacent said first inflation means, (5) actuating means adapted to be grasped by an operator, and (6) means connecting said actuating means to each of said first and second flexible means for movement along their lengths, whereby said first and second inflation means may be operated by pulling said actuating means through a stroke having a predetermined length, said length being substantially unaffected by the direction of said stroke.

5. The apparatus of claim 4 further comprising:

a container, said inflatable raft means (a) being stowed within said container, said raft body being in a deflated folded configuration; and means responsive to pulling said actuating means through said stroke thereof for opening said container to permit substantially unrestrained expansion of said raft body during inflation thereof.

6. The apparatus of claim 4 wherein said first and second inflation means, respectively, comprise first and second inflation tanks, each having an outlet valve with a cam type opening mechanism; said first and second flexible means, respectively, comprise first and second pullout type valve release cables operatively connected, respectively, to the cam mechanisms of said valves of said first and second inflation tanks; and wherein said anchoring means include means securing the outer end of said first cable to said second inflation tank adjacent its outlet valve, and means securing the outer end of said second cable to said first inflation tank adjacent its outlet valve.

7. The apparatus of claim 4 wherein said anchoring means include means for positioning said first and second flexible means relative to each other in such manner that pulling said actuating means through said stroke causes one of said flexible means to be tensioned slightly before the other of said fliexible means.

8. The apparatus of claim 7 wherein said first and second flexible means are of substantially equal lengths.

9. An emergency life raft pack comprising:

(a) a raft body having first and second separately inflatable sections, said raft body being in a deflated condition;

(b) first inflation tank means mounted on said first raft body section and including an outlet valve communicating with the interior thereof;

(c) second inflation tank means mounted on said second raft body section and including an outlet valve communicating with the interior thereof;

(d) first valve-opening cable means connected at an inner end portion thereof to said outlet valve of said first tank means for opening the same to inflate said first raft body section;

(e) means connecting an outer end portion of said first cable means to said second tank means adjacent said outlet valve thereof;

(f) second valve-opening cable means connected at an inner end portion thereof to said outlet valve of said second tank means for opening the same to inflate said second raft body section;

(g) means connecting an outer end portion of said second cable means to said first tank means adjacent said outlet valve thereof;

(h) a container having an open configuration and a closed configuration;

(i) means retaining said container in said closed configuration and being operable to open said container, said elements (a) through (g) being stowed within said container; and (j) manually operable actuating means, secured to said container-opening means and connected to said first and second cable means for movement along their lengths, whereby said container and both of said outlet valves may be opened by pulling said actuating means through an actuating stroke having a predetermined length, said length being substantially independent of the direction of said actuating stroke.

10. The raft pack of claim 9 wherein said actuating means include an operating lanyard and a ring member, said ring member being secured to said lanyard and circumscribing said first and second valve-opening cable means.

11. The raft pack of claim 9 wherein each of said first and second valve-opening cable means has a length longer than the distance between said outlet valves of said first and second inflation tank means.

12. The raft pack of claim 9 wherein said actuating means include an actuating lanyard having an inner portion disposed within said container and secured to said raft body, and an outer portion adapted to be attached to an aircraft or the like, and said means releasably retaining said container in a closed configuration include a container release cable extending around a portion of said container and being connected to said actuating lanyard.

13. The raft pack of claim 9 wherein said first and second release cable means are of substantially equal lengths, and said connecting means (e) and (g) include means for positioning said release cable means relative to each other so that one of said cable means is tensioned slightly before the other of said cable means is tensioned during said actuation stroke, whereby one of said outlet valves is opened slightly before the other of said outlet valves during said actuation stroke.

14. The apparatus of claim 13 wherein said connecting means (e) and (g) include a pair of cable attachment members each secured to a different one of said first and second tank means and having a portion extending outwardly therefrom; wherein said positioning means include a pair of connection members fastened to each of said attachment member outer portions, one of said connection members of each pair thereof being spaced outwardly of the other connection member in such pair; and wherein said connecting means (e) and (g) further include means connecting the outer end of said first release cable means to the outer connection member of said cable attachment member on said second tank means, and means connecting the outer end of said second release cable means to the inner connection member of said cable attachment member on said first tank means.

15. The apparatus of claim 9 wherein said first and second cable means each comprise a pullout type valve release cable, and said first and second tank means are positioned on said raft body so that inflation of one of said sections causes one of said tank means to be moved away from the other of said tank means, whereby, in the event that only one of said valve release cables is pulled from its outlet valve upon attempted use of said actuation means, the resulting inflation of one of said raft body sections will pull the other of said release cables from its outlet valve, thereby inflating the other of said raft body sections.

16. An emergency life raft apparatus comprising:

(a) a raft body having two separately inflatable sections;

(b) a pair of spaced apart tank and valves assemblies each mounted on said raft body for inflating one of said raft body sections;

(c) a pair of valve-opening cables, each of said cables being operatively connected to one of said tank and valve assemblies;

(d) means restraining movement of an outer end portion of each of said valve-opening cables relative to said raft body and positioning said cables so that they extend in generally opposite directions between said tank and valve assemblies;

(e) a cable linking member connected to each of said cables for movement along their lengths between said tank and valve assemblies; and (f) an actuating lanyard secured to said cable linking member to operate said valve-opening cables in response to a pull stroke imposed on said lanyard, whereby the length of said lanyard pull stroke required to open both of the tank valves is substantially constant regardless of the direction in which said lanyard is pulled and, in the event that only one of said cables is operated by the lanyard pull, the resulting inflation of one of said raft body sections automatically operates the other of said cables to insure full inflation of said raft body.

17. The apparatus of claim 16 wherein said cable linking member is generally ring-shaped and circumscribes said valve-opening cables.

18. The apparatus of claim 16 wherein said cables are of substantially equal lengths, and wherein said movement-restraining means (d) include means for anchoring the outer end of each of said cables to one of said tank and valve assemblies, and for positioning one of said outer cable ends relative to the tank and valve assembly to which it is anchored so that one of said cables is tensioned before the other cable during said lanyard pull stroke to thereby provide a predetermined staging in the opening of the tank valves.

19. The apparatus of claim 18 wherein each of said cables has a length longer than the distance between the valves of said tank and valve assemblies, and said movement-restraining means (d) further include means for anchoring each of said outer cable ends to one of the valves of said tank and valve assemblies.

20. For use with an inflatable life raft or the like having a pair of separately inflatable sections each having a tank and valve assembly mounted thereon for inflating the section, the method of constructing an inflation actuation system comprising the steps of:

(a) providing a pair of elongated, flexible opening members adapted for connection to the valves of the tank and valve assemblies to open the valves in response to a pull force exerted on said members;

(b) operatively connecting one of said valve-opening members to the valve of one of the tank and valve assemblies;

(c) operatively connecting the other of said valve-opening members to the valve of the other tank valve assembly;

(d) extending said valve-opening members in generally opposite directions between the tank and valve assemblies;

(e) restraining movement of outer end portions of said valve-opening members relative to the raft;

(f) providing manually operable pull means for operating said valve-opening members to open the valves; and (g) connecting said pull means to said valve-opening members for movement along their lengths between the tank and valve assemblies.

21. The method of claim 20 wherein the valves have cam type opening mechanisms, and wherein said step (a) is performed by furnishing a pair of pullout-type valve release cables.

22. The method of claim 20 wherein said step (a) is performed by furnishing a pair of elongated, flexible valve-opening members each having a length greater then the distance between the valves of the tank and valve assemblies.

23. The method of claim 20 wherein said restraining step (e) is performed by connecting said valve-opening member outer end portion of each of the tank and valve assemblies to the other tank and valve assembly.

24. The method of claim 20 wherein said restraining step (e) includes positioning said valve-opening members relative to one another so that one of said valve-opening members is tensioned before the other of said valve-opening members during operation of said pull means.

25. The method of claim 24 wherein said step (a) is performed by furnishing a pair of elongated, flexible valve-opening members having substantially equal lengths, and wherein said restraining step (e) is performed by furnishing a pair of attachment members each having an inner and outer attachment point, connecting one of the attachment members to one of the tank and valve assemblies, connecting the other attachment member to the other tank and valve assembly, securing the outer end of one of the valve-opening members to the inner connection point of one of the attachment members, and securing the outer end of the other valve-opening member to the outer connection point of the other attachment member.

26. The method of claim 20 wherein said step (f) is performed by furnishing an actuating lanyard having a ring member secured thereto, and said step (g) is performed by circumscribingly connecting said ring member to said valve-opening members.

27. For use with a lanyard and valve release cable inflation actuation system connected to the dual tank and valve assemblies of an inflatable life raft or the like, the system being of the type wherein the inner cable ends are operatively connected to the tank valves and the outer cable ends are fixedly secured to the lanyard, the method of retrofitting the actuating system so that the required length of the lanyard pull stroke does not vary significantly with the direction thereof, said method comprising the steps of:

(a) disconnecting the cables from the lanyard;

(b) providing a cable linking member having an opening formed therethrough;

(c) extending the disconnected cables through said linking member so that it can slide along their lengths;

(d) connecting an outer end portion of the cable of each of the tank and valve assemblies to the other tank and valve assembly; and (e) securing the lanyard to said cable linking member.

28. The method of claim 27 wherein said cable-connecting step (d) includes positioning the cables relative to each other so that pulling the reconnected lanyard in any direction tensions a predetermined one of the reconnected cables slightly before the other reconnected cable.

29. For use with a life raft apparatus or the like having a body with two separately inflatable sections and an inflation system including a pair of spaced apart inflation tanks each having an outlet valve communicating with a different one of the inflatable sections, a pair of pullout-type valve-opening cables each having an inner end portion operatively connected to a different one of the outlet valves, and an activating lanyard fixedly secured to an outer end portion of each cable, a retrofit kit for replacing the lanyard and cable portion of the inflation system, said retrofit kit comprising:

(a) first and second pullout-type valve-opening replacement cables each having inner and outer end portions;

(b) means for connecting said replacement cables to the raft apparatus in such manner that they extend in generally opposite directions between the tanks with the inner end portion of each replacement cable being operatively associated with a different one of the tank valves, and the outer end portion of each replacement cable being restrained against appreciable movement relative to the raft body;

(c) a replacement activating lanyard; and (d) means for attaching said replacement lanyard to the connected replacement cables for movement along their lengths between the inflation tanks.

* * * * *